US010835084B2

(12) United States Patent
Adamson

(10) Patent No.: US 10,835,084 B2
(45) Date of Patent: Nov. 17, 2020

(54) LIQUID DISPENSING APPARATUS, SYSTEM AND METHOD

(71) Applicant: Quinn Jay Adamson, Saratoga Springs, UT (US)

(72) Inventor: Quinn Jay Adamson, Saratoga Springs, UT (US)

(73) Assignee: Earth Dispensing Solutions, Inc., Salt Lake City, UT (US)

( * ) Notice: Subject to any disclaimer, the term of this patent is extended or adjusted under 35 U.S.C. 154(b) by 0 days.

(21) Appl. No.: 16/220,532

(22) Filed: Dec. 14, 2018

(65) Prior Publication Data

US 2020/0187724 A1 Jun. 18, 2020

(51) Int. Cl.

| | |
|---|---|
| ***B67D 7/78*** | (2010.01) |
| ***A47K 5/12*** | (2006.01) |
| ***B05B 11/00*** | (2006.01) |

(52) U.S. Cl.

CPC ..... *A47K 5/12* (2013.01); *B05B 11/0044* (2018.08)

(58) Field of Classification Search

CPC ... A47K 5/12; B05B 11/0044; B05B 11/0097; B05B 11/0056; A61J 9/00; B65D 1/06; B65D 1/04; B65D 1/023; B65D 1/0246; B65D 41/04

See application file for complete search history.

(56) References Cited

U.S. PATENT DOCUMENTS

| | | | | |
|---|---|---|---|---|
| 198,744 | A * | 1/1878 | Johnson | A01K 39/026 119/77 |
| 246,879 | A * | 9/1881 | Hall | B65D 1/06 215/380 |
| 2,355,010 | A * | 8/1944 | Pera | A47G 19/2266 220/710 |
| 4,645,097 | A * | 2/1987 | Kaufman | B67D 7/0222 222/207 |
| 4,930,667 | A | 6/1990 | Holzner, Sr. | |
| 4,940,151 | A * | 7/1990 | Fett | A61J 9/00 215/11.1 |
| 5,238,153 | A | 8/1993 | Castillo et al. | |
| 6,123,230 | A * | 9/2000 | Klima, Jr. | B05B 11/0056 222/82 |
| 8,317,058 | B2 * | 11/2012 | Toth | A47G 19/2266 215/389 |
| 9,498,090 | B2 | 11/2016 | Barclay | |
| 9,522,405 | B2 | 12/2016 | Stehli, Jr. et al. | |
| 9,539,175 | B2 * | 1/2017 | Carlsson | A61J 1/2089 |
| 10,016,772 | B2 * | 7/2018 | Bapat | B05B 11/0054 |
| 10,022,023 | B2 | 7/2018 | Santoro et al. | |
| 2002/0031625 | A1 * | 3/2002 | Klima, Jr. | B05B 11/0056 428/34.1 |

(Continued)

*Primary Examiner* — Frederick C Nicolas
*Assistant Examiner* — Bob Zadeh
(74) *Attorney, Agent, or Firm* — Alexis Nelson; Kirton McConkie

(57) ABSTRACT

An apparatus for dispensing a liquid. The apparatus includes a monolithic container to store a liquid. The monolithic container has a lower reservoir from which to dispense the liquid, an upper reservoir substantially adjacent to the lower reservoir to replenish the liquid in the lower reservoir, and a narrowing between the upper and lower reservoirs. An exit port communicates with the lower reservoir and is oriented in an upward direction relative to the lower reservoir. A corresponding system and method are also disclosed and claimed herein.

13 Claims, 7 Drawing Sheets

(56) References Cited

U.S. PATENT DOCUMENTS

| | | | | |
|---|---|---|---|---|
| 2006/0255069 | A1* | 11/2006 | Bonner | B67D 7/00 222/207 |
| 2010/0276455 | A1* | 11/2010 | Corbin | A47K 5/1208 222/205 |
| 2014/0175126 | A1* | 6/2014 | Carlsson | A61M 1/1666 222/145.5 |

* cited by examiner

LIQUID DISPENSING APPARATUS, SYSTEM AND METHOD

BACKGROUND

Field of the Invention

This invention relates to liquid dispensers.

Background of the Invention

The primary aim of product packaging is to keep products clean, fresh, and safe for their intended purpose. At the very least, product packaging should contain a product, protect the product, and provide tamper resistance. Depending on the product, product packaging may also provide physical protection from shock, compression, vibration, temperature, and bacteria. Product packaging may further provide barrier protection from dust, oxygen and/or water vapor. Desiccants or oxygen absorbers may be added to product packaging to help extend product shelf life.

Comprising about 21% oxygen, air is the primary enemy to freshness, particularly when it comes to consumable liquid and viscous products like food, condiments, soap, hand sanitizer, shampoo, conditioner, lotion and other such products. Indeed, oxygen is primarily responsible for the deterioration of fats, food colors, vitamins, flavors, and other food constituents. Oxygen causes such deterioration by: (1) providing conditions that enhance the growth of microorganisms; (2) activating enzymes that catalyze chemical reactions between oxygen and product components; and (3) causing oxidation. To optimize product freshness and longevity, it is thus critical to limit exposure of stored products to air.

In view of the foregoing, what are needed are apparatuses, systems and methods for storing and dispensing liquid and viscous products while limiting their exposure to air. Also what are needed are apparatuses, systems, and methods that extend the expected shelf life of dispensable products. Ideally, such apparatuses, systems and methods would be simple and efficient to manufacture and use, inexpensive, and reusable. Such apparatuses, systems and methods are disclosed and claimed herein.

BRIEF DESCRIPTION OF DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

As previously discussed, exposure to air is a primary cause of deterioration and spoilage of consumable liquid and viscous products. The shelf life of such products may be significantly extended by limiting exposure to air. Apparatuses, systems and methods in accordance with the invention address these issues by providing a vacuum-packed container with a dispensing mechanism that prevents continual airflow to stored products.

As used herein, the term "liquid" refers to any fluid, viscous, or semi-viscous product. The term "condiment" includes ketchup, mustard, mayonnaise, barbeque sauce, liquid butter, and any other such dispensable food product known to those in the art.

Figure 1:
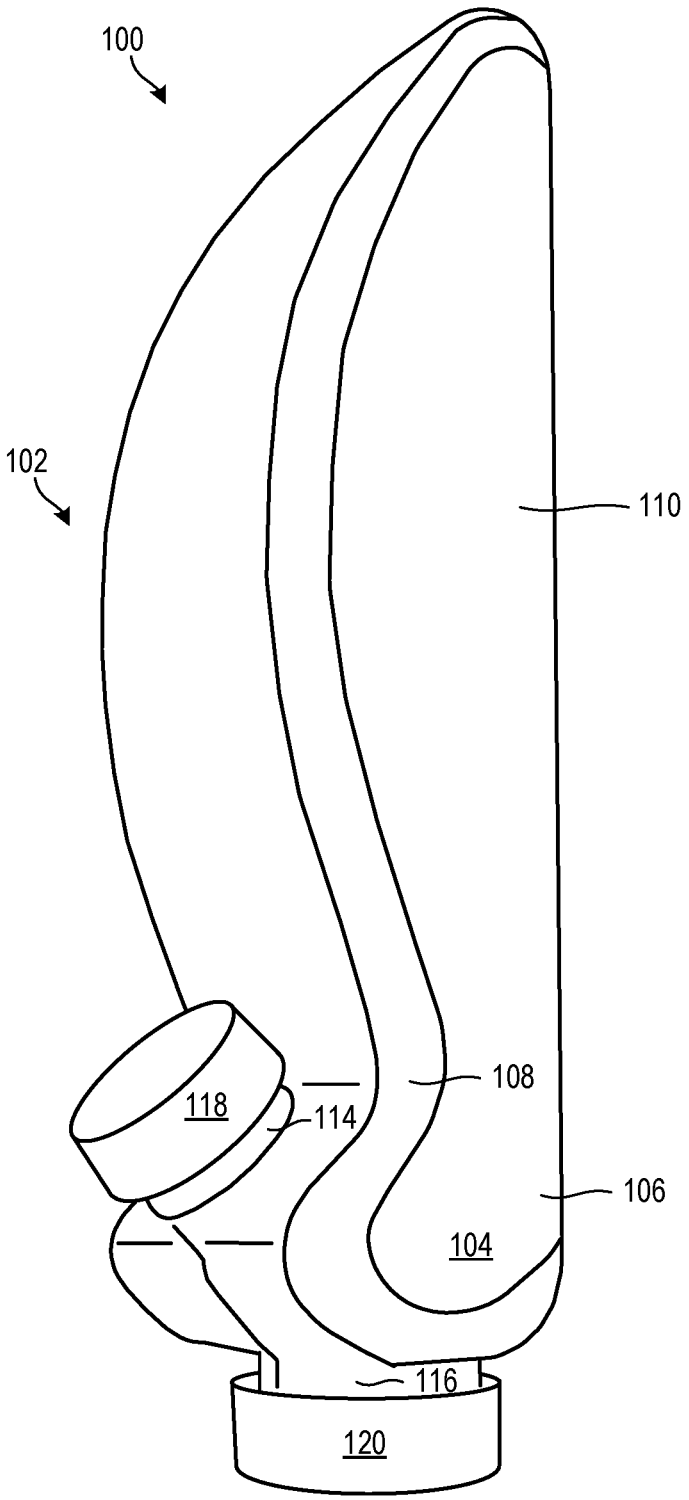
FIG. 1 is perspective view of one embodiment of a liquid dispensing apparatus in accordance with the invention.
Figure 2:
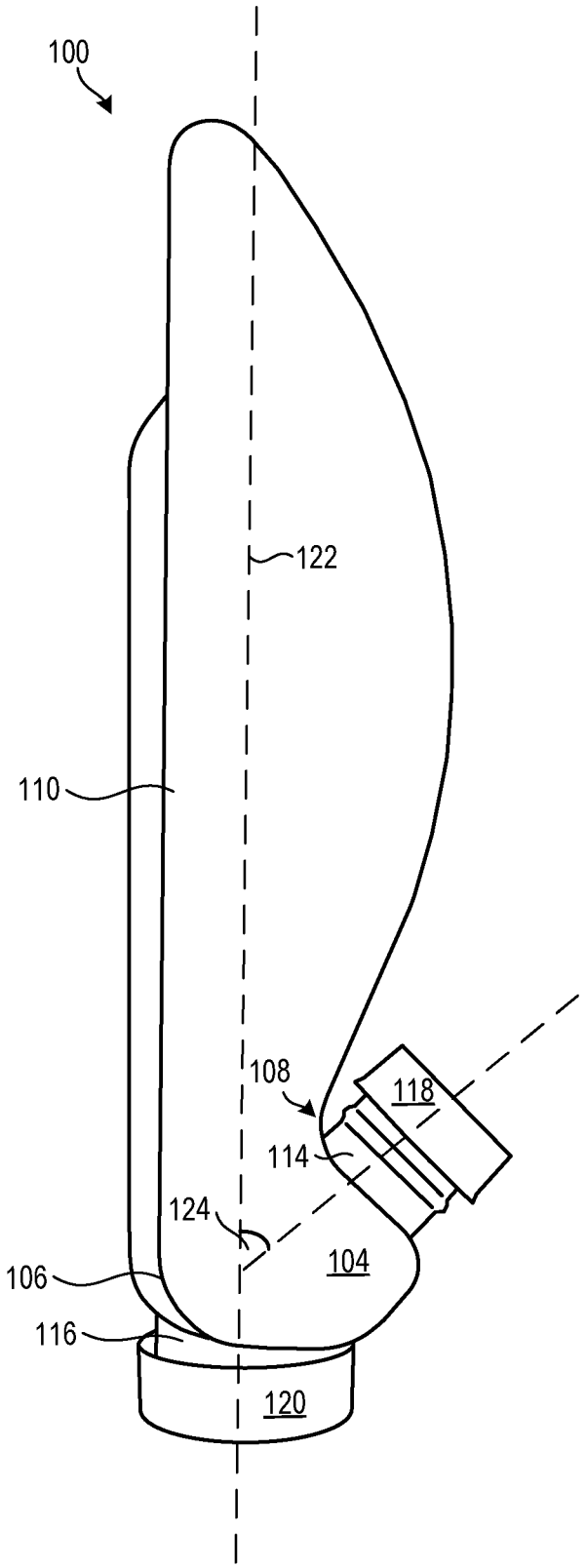
FIG. 2 is a side view of a liquid dispensing apparatus in accordance with embodiments of the invention.

Referring now to FIGS. 1 and 2, an apparatus 100 in accordance with embodiments of the invention may include a monolithic container 102 to store and dispense a liquid 104. In some embodiments, the monolithic container 102 may contain and dispense, for example, food, condiments, ketchup, mustard, mayonnaise, barbeque sauce, liquid butter, soap, liquid cleanser, foaming cleanser, hand sanitizer, shampoo, conditioner, lotion, and/or the like. In other embodiments, the monolithic container 102 may be used as a hand-held spray bottle, a hummingbird feeder, a baby bottle for milk or formula, or for any other purpose known to those in the art.

In some embodiments, the monolithic container 102 may be substantially rigid and may store liquid 104, viscous, or semi-viscous products that substantially conform to the shape of the container 102. The monolithic container 102 may be fabricated from a material including one or more plastics such as polycarbonate, polyethylene, polypropylene, thermoplastic elastomer ("TPE"), or other such plastics or composite materials known to those in the art. In other embodiments, the monolithic container 102 may be fabricated from a material or materials containing glass, metal, wood, laminated cardboard or other paper, a combination thereof, or any other suitable material known to those in the art.

In certain embodiments, the monolithic container 102 may be fabricated using techniques such as welding, compounding, lamination, molding, extrusion, 3D printing, or any other such fabrication technique or combination of techniques known to those in the art. In one embodiment, a blow-molding process may be used to inject polyurethane into a steel-cavity mold to fabricate the monolithic container 102.

The monolithic container 102 may include a lower reservoir 106 from which to dispense the liquid 104, and an upper reservoir 110 substantially adjacent to the lower reservoir 106. The upper reservoir 110 may replenish the liquid 104 in the lower reservoir 106 as it is dispensed, as discussed in more detail below. A narrowing 108 in the monolithic container 102 may be provided between the lower reservoir 106 and the upper reservoir 110.

In some embodiments, the lower reservoir 106 may include an exit port 114 through which the liquid 104 may be selectively dispensed. The exit port 114 may be incorporated into or coupled to the lower reservoir 106. In certain embodiments, the exit port 114 may extend outwardly from the lower reservoir 106, and may be oriented in an upward direction relative a vertical axis 122 of the monolithic container 102. In one embodiment, the exit port 114 may extend from the lower reservoir 106 at an angle 124 less than ninety degrees (90°) relative to the vertical axis 122 of the monolithic container 102. In some embodiments, a secondary manufacturing process, such as drilling, may be used to form a hole and/or lip in the exit port 114, as discussed in more detail with reference to FIG. 5 below.

In one embodiment, a cap 118 may be removably coupled to the exit port 114. The cap 118 may be applied to the exit port 114 to prevent the liquid 104 from unintentionally exiting the monolithic container 102. The cap 118 may include an attachment mechanism to attach the cap 118 to the exit port 114.

In some embodiments, for example, the cap 118 may include internal threads formed to mate with threads incorporated into an external surface of the exit port 114. In other embodiments, the cap 118 may attach to the exit port 114 via one or more hooks, clips, slide-in connectors, mating geometric features, or any other such attachment mechanism or mechanisms known to those in the art. In one embodiment, the cap 118 may include a rubber or plastic stopper that substantially seals the exit port 114 via a press fit. In certain embodiments, the cap 118 may be selectively omitted and/or replaced by a dispensing device, as discussed in more detail below.

In certain embodiments, as discussed in more detail with reference to FIG. 6 below, the monolithic container 102 may include an inlet port 116 to facilitate receiving the liquid 104 into the monolithic container 102. The inlet port 116 may be incorporated into or coupled to the lower reservoir 106. In some embodiments, as shown, the inlet port 116 may extend outwardly and in a downward direction from the lower reservoir 106. In other embodiments, the inlet port 116 may comprise an opening integrated into the lower reservoir 106. A lid 120 may be removably coupled to the inlet port 116 by any means known to those in the art.

In certain embodiments, the cap 118 and the lid 120 may be used to selectively close or seal either or both of the inlet and exit ports 116, 114. By closing such inlet and exit ports 116, 114, the monolithic container 102 may be easily used to transport liquids 104 stored therein. This feature may be particularly advantageous for users wishing to transport liquids 104 such as condiments for camping trips, sun lotions or personal hygiene products for the beach, shampoos and conditioners for the gym, and/or the like.

Figure 3:
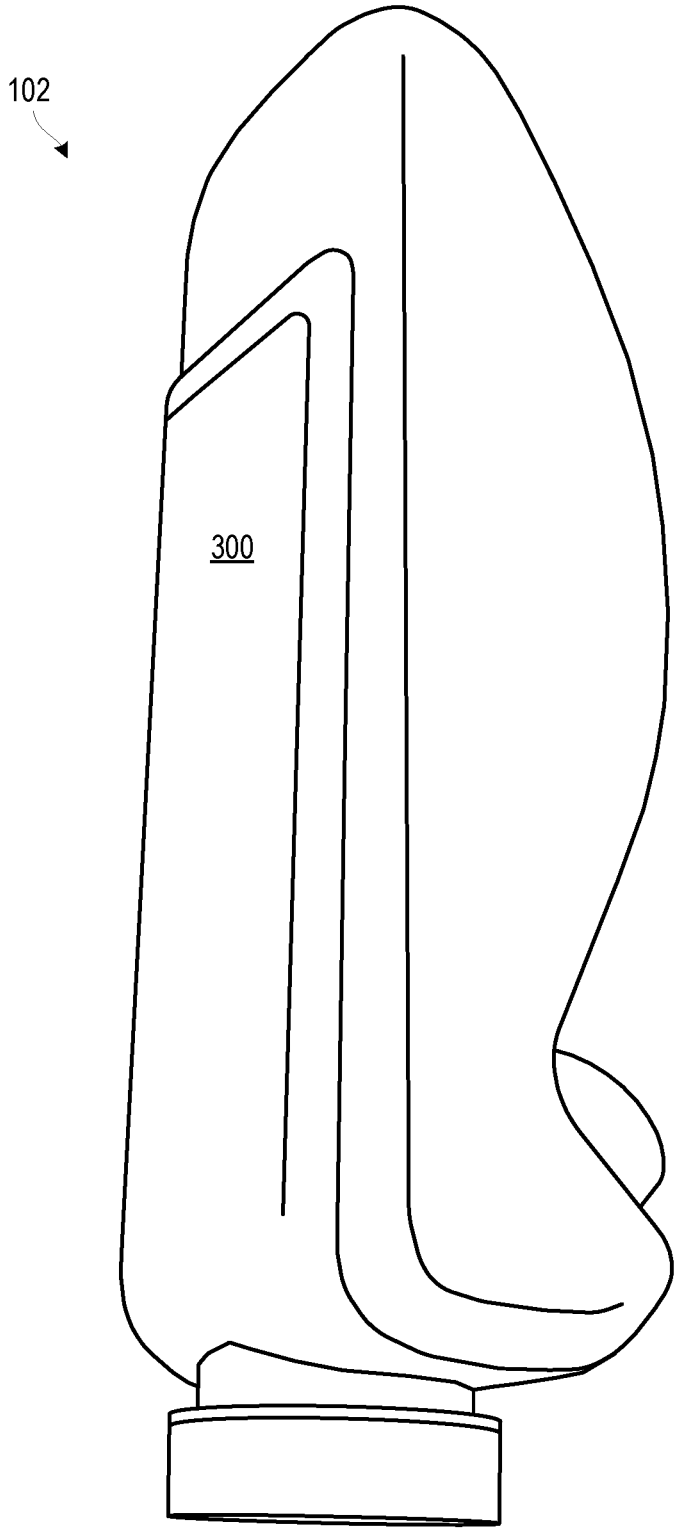
FIG. 3 is a three-quarters perspective view of one embodiment of a liquid dispensing apparatus having an attachment feature in accordance with the invention.

Referring now to FIG. 3, some embodiments of an apparatus 100 for dispensing a liquid 104 in accordance with the invention may include an attachment feature 300 integrated into or coupled to the monolithic container 102. The attachment feature 300 may facilitate mounting the monolithic container 102 to a wall or other surface for easy access and use. In some embodiments, the attachment feature 300 may enable the monolithic container 102 to be dropped into, slid into, or otherwise coupled to or integrated with an existing dispensing device or apparatus having corresponding mechanical features to retain the monolithic container 102 and dispense liquid 104 therefrom.

For example, in one embodiment, the attachment feature 300 may include a protrusion integrated into a back surface 302 of the monolithic container 102. The geometry of the protrusion may enable the monolithic container 102 to mechanically mate with corresponding geometric features of a dispensing device. In certain embodiments, the dispensing device may further include a pump mechanism or other device to enable a user to draw liquid 104 from the lower reservoir 106 of the monolithic container 102. In this manner, the monolithic container 102 may be easily coupled to the dispensing device and the combination of the monolithic container 102 and the dispensing device may be used to dispense the liquid 104 stored therein. The attachment feature 300 may further facilitate removing and/or replacing the monolithic container 102 as desired. In other embodiments, the attachment feature 300 may include any other mechanical attachment mechanism known to those in the art.

Figure 4:
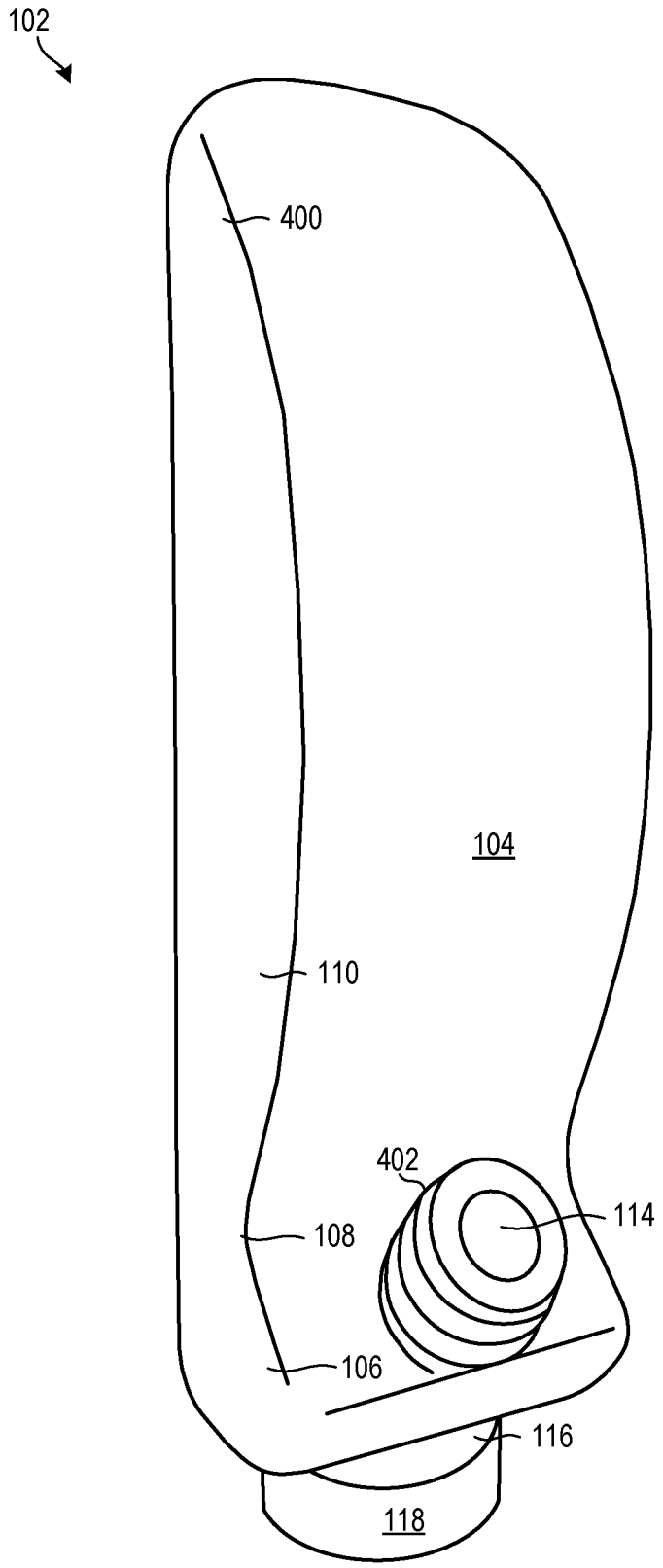
FIG. 4 is a perspective view of another embodiment of a liquid dispensing apparatus in accordance with the invention.

Referring now to FIG. 4, in operation, the liquid 104 may be first received into the monolithic container 102. As previously mentioned, in some embodiments, the liquid 104 may be received into an inlet port 116 incorporated into the lower reservoir 106 and oriented in a downward direction relative thereto. To facilitate filling the monolithic container 102 with the liquid 104, the monolithic container 102 may be inverted such that the inlet port 116 and lower reservoir 106 are located above the upper reservoir 110. The liquid 104 may thus fill the upper reservoir 110 first. Upon filling the monolithic container 102 with a desired amount of liquid 104, the inlet port 116 may be substantially sealed with a cap 118 or other such device to prevent liquid 104 from spilling from the monolithic container 102 when the monolithic container 102 is returned to an upright position.

To facilitate dispensing the liquid 104, the monolithic container 102 may be tilted or inverted such that the upper reservoir 110 is above the lower reservoir 106. When the monolithic container 102 is vertically tilted, gravity exerts a downward force on the liquid 104. This downward force creates a negative pressure or vacuum at the top of the upper reservoir 110, in a chamber 400 above the liquid 104. The force of gravity pulling down on the liquid 104 is countered by a substantially equal force of the vacuum pulling up on the liquid 104, thereby providing a liquid 104 level substantially held at equilibrium.

Dispensing liquid 104 from the monolithic container 102 may alter this equilibrium. Air may enter the monolithic container 102 and rise to the vacuum chamber 400 above the upper reservoir 110 in a volume substantially equal to the dispensed liquid 104. This process may allow the liquid 104 level to be reduced while still preventing the liquid 104 from spilling out of the exit port 114.

Specifically, as air enters the monolithic container 102, it may expand in the exit port 114 to force air bubbles under a gate 402 formed by the junction between the exit port 114 and the lower reservoir 106. The air bubbles may move past the gate 402 and rise to the vacuum chamber 400 above the upper reservoir 110. In the vacuum chamber 400, the air bubbles may expand to replace the liquid 104 as it is dispensed. The vacuum may thus be reduced, allowing the liquid 104 to dispense and the liquid 104 level to decrease within the upper reservoir 110. In this manner, the vacuum chamber 400 may control or regulate the flow of liquid 104 as it descends into the lower reservoir 106.

Beneficially, the vacuum chamber 400 may also keep the liquid 104 fresh for longer periods of time within the monolithic container 102. Indeed, the vacuum chamber 400 may provide a vacuum-packed environment for the liquid 104 in the upper reservoir 110 of the monolithic container 102, thereby slowing bacteria growth therein.

Figure 5:
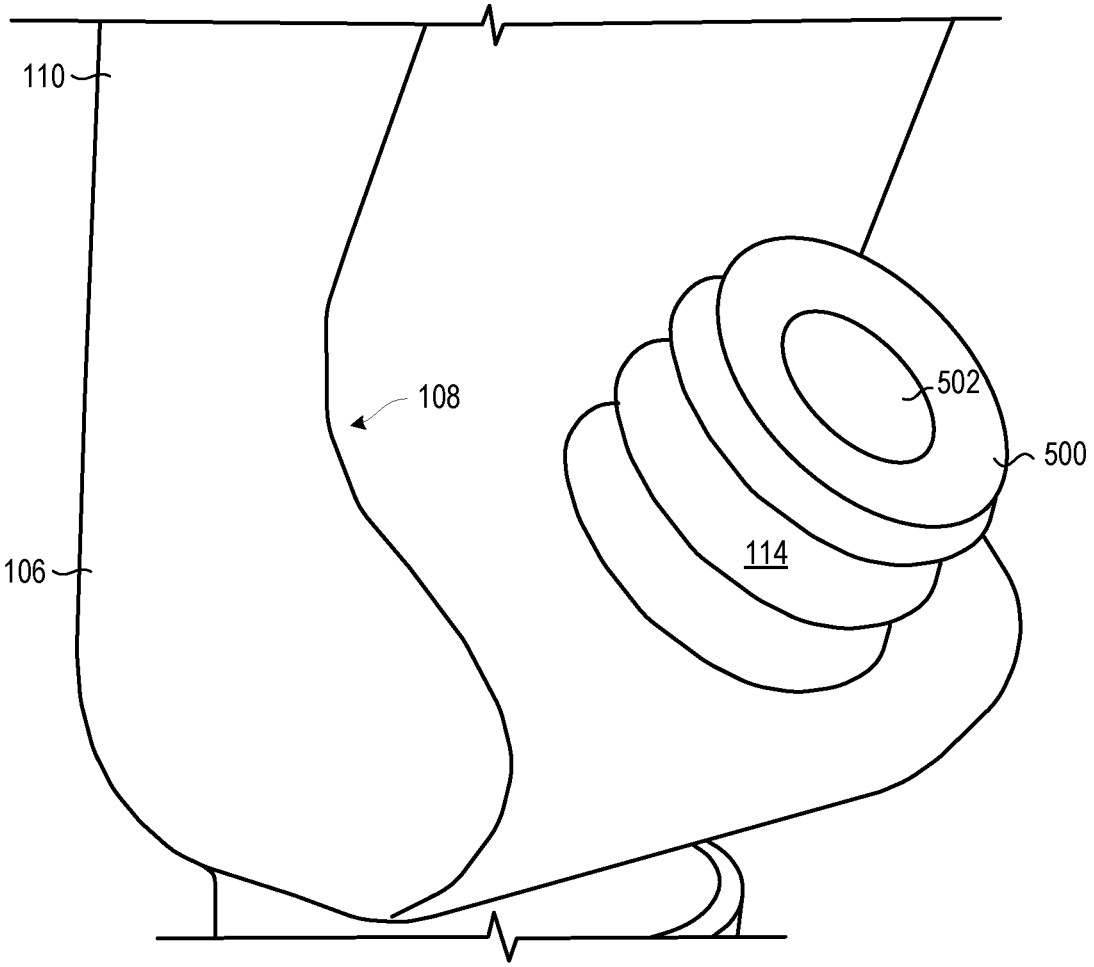
FIG. 5 is a perspective view of an exit port of a liquid dispensing apparatus in accordance with some embodiments of the invention.

Referring now to FIG. 5, in some embodiments, a secondary manufacturing process, such as drilling, may be used to form a lip 500 and/or a hole in the exit port 114. The hole 502 may provide an exit route for liquid 104 to be dispensed out of the monolithic container 102. In some embodiments, the hole 502 may be incorporated into an exit port 114 that extends outwardly in an upward direction from the lower reservoir 106. In other embodiments, the hole 502 may be the exit port 114. In certain embodiments, the hole 502 may include dimensions sufficient to accommodate at least a portion of a dispensing device, such as a pump reservoir and/or dip tube. The dip tube may communicate with liquid 104 in the lower reservoir 106, while the dispensing device may be attached to the exit port 114 and used to dispense the liquid 104 from the monolithic container 102.

In certain embodiments, the lip 500 may be formed to substantially surround a circumference or perimeter of the hole 502. In some embodiments, the lip 500 may facilitate retention of liquids 104 supported by the vacuum and held within the exit port 114. The lip 500 may also provide an additional seal when a cap 118 or dispensing device is coupled to the exit port 114.

Figure 6:
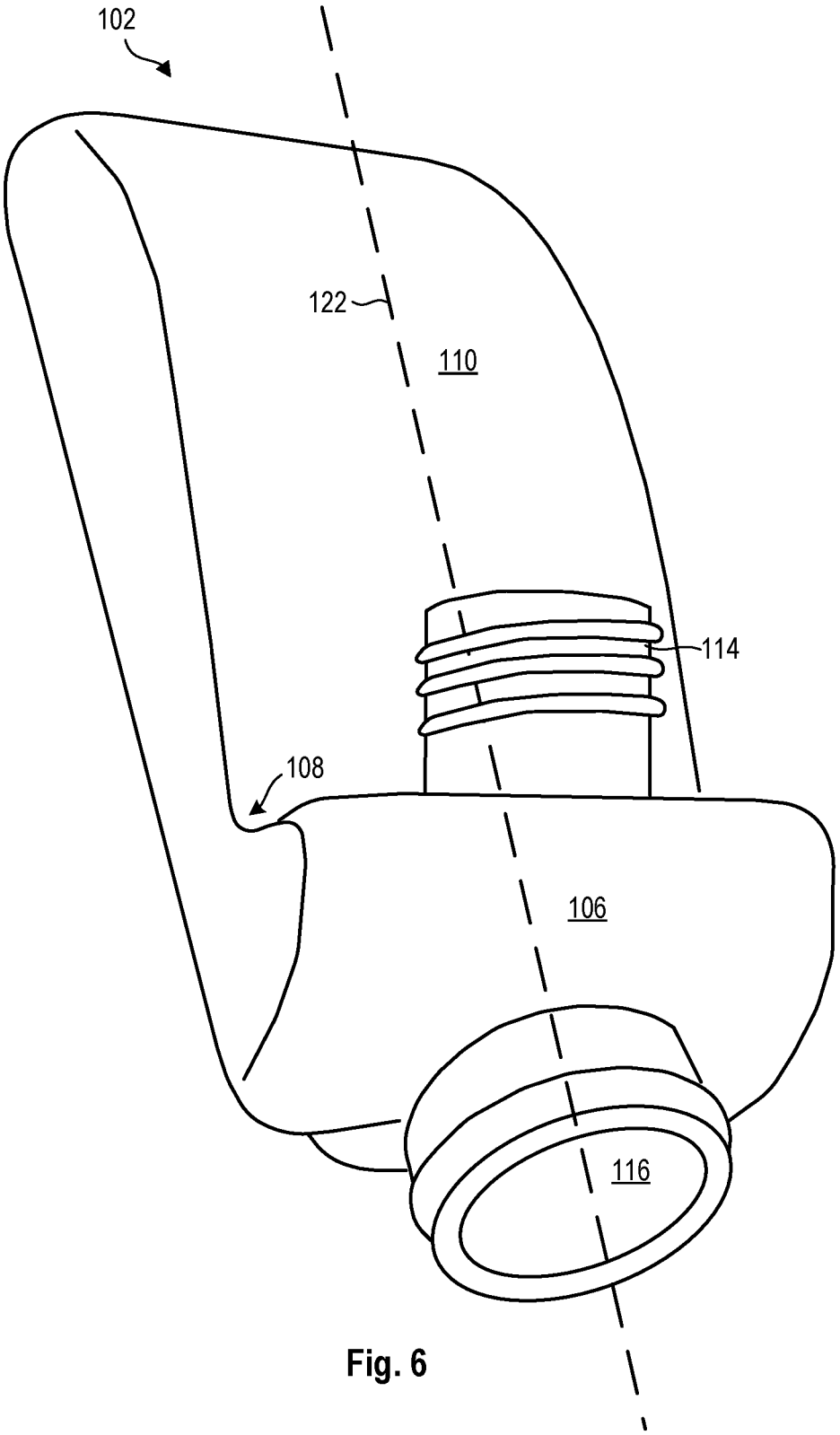
FIG. 6 is a bottom perspective view of an embodiment of a liquid dispensing apparatus having an inlet port in accordance with certain embodiments of the invention.

Referring now to FIG. 6, as mentioned above, some embodiments in accordance with the invention may include an inlet port 116 to facilitate filling and/or emptying the liquid 104 from the monolithic container 102. As shown, in some embodiments, the inlet port 116 may extend outwardly from the lower reservoir 106, in a downward direction relative relative thereto.

In one embodiment, the inlet port 116 may be oriented in a direction substantially parallel to a vertical axis 122 of the monolithic container 102. The monolithic container 102 may be tilted or inverted to receive the liquid 104 into the monolithic container 102 through the inlet port 116, and may be returned to a substantially upright or vertical position to dispense the liquid 104 from the exit port 114. Returning the monolithic container 102 to an upright or vertical position in this manner may create a negative pressure or vacuum at the top of the upper reservoir 110 in a vacuum chamber 400 above the liquid 104, as discussed above.

As previously mentioned, a lid 120 may be removably coupled to the inlet port 116. The lid 120 may be applied to the inlet port 116 to effectively contain the liquid 104 within the monolithic container 102. Like the cap 118, the lid 120 may include an attachment mechanism to attach to the inlet port 116. In some embodiments, for example, the lid 120 may include internal threads formed to mate with threads incorporated into an external surface of the inlet port 116. In other embodiments, the lid 120 may attach to the inlet port 116 via one or more hooks, clips, slide-in connectors, mating geometric features, or any other attachment mechanism or mechanisms known to those in the art. In one embodiment, the lid 120 may be a rubber or plastic stopper that substantially seals the inlet port 116 via a press fit.

Figure 7:
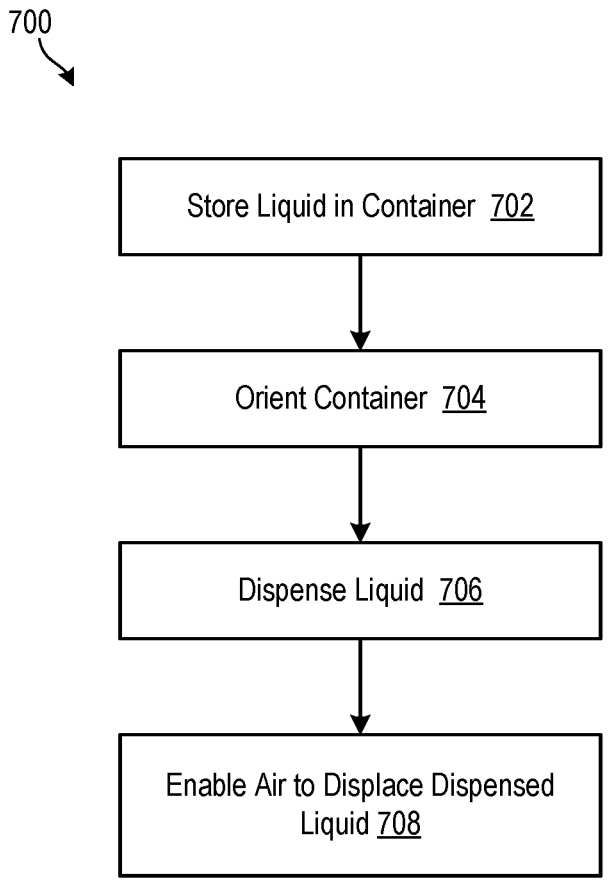
FIG. 7 is a flow chart showing a process for using a liquid dispensing apparatus in accordance with embodiments of the invention.

Referring now to FIG. 7, a process 700 for dispensing liquid 104 in accordance with embodiments of the invention may include storing 702 the liquid 104 in a container. The container may be a monolithic container 102 as described above.

Specifically, the monolithic container 102 may have a lower reservoir 106 from which to dispense the liquid 104, an upper reservoir 110 substantially adjacent to the lower reservoir 106 to replenish the liquid 104 in the lower reservoir 106, and a narrowing 108 therebetween. An exit port 114 may communicate with the lower reservoir 106 and be oriented in an upward direction with respect thereto. In some embodiments, the exit port 114 may extend from the lower reservoir 106 at an angle 124 less than 90 degrees relative to a vertical axis 122 of the monolithic container 102.

In one embodiment, storing 702 the liquid 104 may include receiving the liquid 104 into the monolithic container 102. The liquid 104 may be received through an inlet port 116 incorporated into the lower reservoir 106. The inlet port 116 may extend from the monolithic container 102 in a substantially downward direction, such that the inlet port 116 is substantially parallel to a vertical axis 122 of the monolithic container 102. Receiving the liquid 104 through the inlet port 116 in this manner may thus require inverting the monolithic container 102 to allow gravity to act on the liquid 104 to fill the monolithic container 102.

Upon storing the liquid 104, the monolithic container 102 may be oriented 704 such that the upper reservoir 110 is above the lower reservoir 106. In some embodiments, orienting 704 the monolithic container 102 in this way may require substantially sealing the inlet port 116 to enable the monolithic container 102 to be tilted or substantially inverted without spilling the liquid 104 from the monolithic container 102.

Orienting 704 the monolithic container 102 in this manner may create a vacuum above the upper reservoir 110. The liquid 104 may then be dispensed 706 through the exit port 114. In some embodiments, the exit port 114 may include a hole 502 communicating with at least a portion of a dispensing device. The dispensing device may be used to dispense 706 the liquid 104 from the lower reservoir 106. In one embodiment, for example, the dispensing device may include a pump mechanism having a dip tube that may be placed through the hole 502 to draw liquid 104 from the lower reservoir 106. The pump mechanism may be coupled to the exit port 114 by any attachment mechanism known to those in the art.

As discussed in detail above, the process 700 may further include enabling 708 air to enter the monolithic container 102 through the exit port 114 to displace the liquid 104 as it is dispensed 706 from the lower reservoir 106. In certain embodiments, the process 700 may enable 708 the air to rise towards the vacuum chamber 400 above the upper reservoir 110.

Specifically, in certain embodiments, air entering the monolithic container 102 through the exit port 114 may expand in the exit port 114 and crest under a gate 402 created by an intersection between the exit port 114 and the lower reservoir 106. The air may then bubble upwards through the upper reservoir 110, toward the vacuum chamber 400. The air may expand in the vacuum chamber 400 to a volume equal to the volume of dispensed liquid 104.

Embodiments of a process 700 for dispensing a liquid 104 in accordance with the invention may minimize exposure of stored liquid 104 to air, while facilitating efficient dispensing of such liquid 104 as desired. Embodiments of the invention may thus provide an air-regulated dispensing process 700 that may prolong a shelf life of the stored liquid 104.

What is claimed is:

1. An apparatus for dispensing a liquid, comprising:

a monolithic container to store the liquid, the container having a lower reservoir from which to dispense the liquid, an upper reservoir substantially adjacent to the lower reservoir to replenish the liquid in the lower reservoir, a narrowing between the upper and lower reservoirs, an exit port communicating with the lower reservoir and oriented in an upward direction relative to the lower reservoir, and an inlet port located at a distance separated from the exit port, the inlet port incorporated into the lower reservoir configured to receive the liquid.

2. The apparatus of claim 1, wherein the monolithic container is substantially rigid.

3. The apparatus of claim 1, wherein the inlet port is oriented in a downward direction relative to the lower reservoir.

4. The apparatus of claim 1, wherein the exit port extends at an angle less than 90 degrees relative to a vertical axis of the monolithic container.

5. The apparatus of claim 1, wherein the exit port comprises a lip to assist in retaining the liquid within the exit port.

6. The apparatus of claim 1, wherein an outer surface of the exit port comprises a plurality of threads to engage at least one of a cap and a pump device.

7. The apparatus of claim 1, wherein the liquid comprises a substantially viscous liquid selected from the group consisting of food, condiments, ketchup, mustard, mayonnaise, barbeque sauce, liquid butter, soap, liquid cleanser, foaming cleanser, hand sanitizer, shampoo, conditioner, and lotion.

8. The apparatus of claim 1, wherein the narrowing is substantially laterally aligned with the exit port.

9. The apparatus of claim 1, wherein an intersection between the exit port and the lower reservoir creates a gate under which air crests towards the upper reservoir.

10. A system for dispensing a liquid, comprising:

a monolithic container to store the liquid, the container having a lower reservoir from which to dispense the liquid, an upper reservoir substantially adjacent to the lower reservoir to replenish the liquid in the lower reservoir, a narrowing between the upper and lower reservoirs, an exit port communicating with the lower reservoir and oriented in an upward direction relative to the lower reservoir, and an inlet port located at a distance separated from the exit port, the inlet port incorporated into the lower reservoir configured to receive the liquid; and a pump device coupled to the exit port, the pump device comprising a dip tube to draw the liquid from the lower reservoir upon actuation of the pump device.

11. The system of claim 10, wherein the inlet port is oriented in a downward direction relative to the lower reservoir.

12. The system of claim 10, wherein the exit port extends at an angle less than 90 degrees relative to a vertical axis of the monolithic container.

13. The system of claim 10, wherein an intersection between the exit port and the lower reservoir creates a gate under which air crests towards the upper reservoir upon actuation of the pump device.

* * * * *